US005588898A

United States Patent [19]

Ooba

[11] Patent Number: 5,588,898

[45] Date of Patent: Dec. 31, 1996

[54] DOLL TOY HEAD ROTATION DEVICE

[75] Inventor: Hideki Ooba, Tokyo, Japan

[73] Assignee: Kabushiki Kaisha Plex, Japan

[21] Appl. No.: 542,305

[22] Filed: Oct. 12, 1995

[30] Foreign Application Priority Data

Mar. 10, 1995 [JP] Japan ..... 7-079929

[51] Int. Cl.[6] ..... A63H 3/12

[52] U.S. Cl. ..... 446/321; 446/330

[58] Field of Search ..... 446/321, 330, 446/300, 338, 384, 376, 359

[56] References Cited

U.S. PATENT DOCUMENTS

| | | | |
|---|---|---|---|
| 4,605,381 | 8/1986 | MacBain et al. | 446/321 |
| 5,417,606 | 5/1995 | Kimura | 446/321 |

FOREIGN PATENT DOCUMENTS

| | | |
|---|---|---|
| 5-11912 | 3/1993 | Japan . |
| 5-11914 | 3/1993 | Japan . |
| 5-11915 | 3/1993 | Japan . |
| 5-11916 | 3/1993 | Japan . |
| 5-24400 | 6/1993 | Japan . |
| 5-25678 | 6/1993 | Japan . |
| 5-45355 | 11/1993 | Japan . |

*Primary Examiner*—Mickey Yu
*Attorney, Agent, or Firm*—Graham & James LLP

[57] ABSTRACT

A doll toy head rotation device of which the head parts can be switched instantly and in which because the head parts are rotated inside the chest part and the back part with these parts fully open the head parts can be switched smoothly without catching on anything. A front plate 43 is open/closably mounted in a front opening 15 in a torso part 11, a rear plate 50 is open/closably mounted in a rear opening 17, and an upper plate 60 is rotatably mounted in an upper opening 16. An upper head part 70 is mounted on the upper surface of the upper plate 60 and a lower head part 72 is mounted on the lower surface. The front plate 43 and the rear plate 50 are linked together and open substantially simultaneously. A pinion 66 is provided on the upper plate 60. A rack 54 which meshes with the pinion 66 is provided on the rear plate 50. When the rear plate 50 opens, the pinion 66 rotates and inverts the upper plate 60.

9 Claims, 6 Drawing Sheets

1/5

71
70
2a
61
65
60
64
24
2
8
63
5
11
13
30
67
68
8
33
72
66
17
28
50
2a
21
56
8
27
48
54
6
16
47
2
40
39
52
55
6
11
5
53
29
12
57
51
58
32
15
43
46
41
44
45
37
6
20
3a
35
25
23
26
22
3
3

DOLL TOY HEAD ROTATION DEVICE

BACKGROUND OF THE INVENTION

This invention relates to a doll toy head rotation device having different upper and lower head parts whose positions can be instantly switched by a simple operation so that the face changes.

In a conventional doll toy head rotation device, for example as shown in Japanese Utility Model Publication No. H.5-11916, an arm part is rotated and this rotates head parts by way of a rotary shaft or the like. The rotating head parts push the inner surfaces of a chest part and a back part, and the chest part and the back part are pushed open outward against the elastic force of a spring. A head part which had been inside the torso part rotates upward out of the torso part, and a head part which had been outside rotates downward and disappears into the torso part. When the switching of the head parts is completed, the chest part and the back part are returned to their original closed states by the elastic force of the spring.

With a conventional doll toy head part rotation device, because to switch the head parts it is necessary each time to rotate an arm part, there has been the problem that the operation is troublesome and it is not possible to switch the head parts instantly. Also, because switching of the head parts is effected by the relatively slow movement of rotating an arm part, it is easy to understand how the head parts are being switched and consequently it is impossible to surprise someone watching and the toy is relatively uninteresting.

Also, because the head parts open the chest part and the back part against the resistance of a spring, there has been the problem that when the head part which was outside rotates toward the inside of the torso part the head part catches on the upper edge of the chest part or the back part and consequently cannot push open the chest part or back part and switching of the head parts cannot be carried out smoothly.

SUMMARY OF THE INVENTION

This invention was devised in view of these problem points, and an object of the invention is to provide a doll toy head rotation device of which the head parts can be switched instantly and in which because the head parts are rotated between the chest part and the back part with these parts fully open the head parts do not catch on anything and can be switched smoothly.

As first means for achieving the above object and other objects, a doll toy head rotation device according to the invention has a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are so linked to each other that they open substantially simultaneously; and (e) the upper plate is provided with a rotary body having the rotational center of the upper plate as its center; and (f) the front plate or the rear plate is provided with a pivoting member which after that plate opens through a predetermined angle rotates the rotary body and does not rotate the rotary body when the plate closes.

As specific second means for achieving the above object and other objects, the invention can also have a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the front plate extends above the projection of the rear plate;

(f) the upper plate is integrally provided with a pinion having the rotational center of the upper plate as its center, and toothless portions are provided on two sides of the pinion;

(g) the rear plate is provided with a side wall, and a rack which when the rear plate has opened through a predetermined angle meshes with the pinion of the closed upper plate and rotates the upper plate is provided at the front end of the upper edge of the side wall;

(h) the upper end of the front plate when it is closing the front opening under the action of the first elastic body abuts with the front end of the upper plate and the upper end of the rear plate when it is closing the rear opening under the action of the second elastic body abuts with the rear end of the upper plate; and (i) when the upper plate and the front plate and the rear plate are closed they constitute part of the torso part and one of the head parts is outside the torso part and the other head part is inside the torso part.

As third means consisting of the constitution of the second means front-rear reversed, the invention can also have a constitution wherein:

(a) there is provided a hollow torso part and a front opening is provided in the front of the torso part, an upper opening is provided ill the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the rear plate extends above the projection of the front plate;

(f) the upper plate is integrally provided with a pinion having the rotational center of the upper plate as its center, and toothless portions are provided on two sides of the pinion;

(g) the front plate is provided with a side wall, and a rack which when the front plate has opened through a predetermined angle meshes with the pinion of the closed upper plate and rotates the upper plate is provided at the rear end of the upper edge of the side wall;

(h) the upper end of the front plate when it is closing the front opening under the action of the first elastic body abuts with the front end of the upper plate and the upper end of the rear plate when it is closing the rear opening under the action of the second elastic body abuts with the rear end of the upper plate; and (i) when the upper plate and the front plate and the rear plate are closed they constitute part of the torso part and one of the head parts is outside the torso part and the other head part is inside the torso part.

As fourth means for achieving the above object and other objects, the invention may also have a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the rear plate is provided with an elastic body for urging the rear plate in the direction in which it closes the rear opening;

(e) an upper/lower pair of projections are provided on the inner side of the front plate and a projection which fits between the pair of projections on the front plate is provided on the inner side of the rear plate, and when the rear plate is closed by the elastic body the projection on the rear plate pushes the lower projection of the front plate and closes the front plate;

(f) the upper plate is integrally provided with a pinion having the rotational center of the upper plate as its center, and toothless portions are provided on two sides of the pinion;

(g) the rear plate is provided with a side wall, and a rack which when the rear plate has opened through a predetermined angle meshes with the pinion of the closed upper plate and rotates the upper plate is provided at the front end of the upper edge of the side wall;

(h) the upper end of the rear plate when it is closing the rear opening under the action of the elastic body abuts with the rear end of the upper plate and the upper end of the front plate when it is closing the front opening under the action of the projection of the rear plate pushing the lower projection of the front plate abuts with the front end of the upper plate; and (i) when the upper plate and the front plate and the rear plate are closed they constitute part of the torso part and one of the head parts is outside the torso part and the other head part is inside the torso part.

As fifth means consisting of the constitution of the fourth means front-rear reversed, the invention can also have a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate is provided with an elastic body for urging the rear plate in the direction in which it closes the front opening;

(e) an upper/lower pair of projections are provided on the inner side of the rear plate and a projection which fits between the pair of projections on the rear plate is provided on the inner side of the front plate, and when the front plate is closed by the elastic body the projection on the front plate pushes the lower projection of the rear plate and closes the rear plate;

(f) the upper plate is integrally provided with a pinion having the rotational center of the upper plate as its center, and toothless portions are provided on two sides of the pinion;

(g) the front plate is provided with a side wall, and a rack which when the front plate has opened through a predetermined angle meshes with the pinion of the closed upper plate and rotates the upper plate is provided at the rear end of the upper edge of the side wall;

(h) the upper end of the front plate when it is closing the front opening under the action of the elastic body abuts with the front end of the upper plate and the upper end of the rear plate when it is closing the rear opening under the action of the projection of the front plate pushing the lower projection of the rear plate abuts with the rear end of the upper plate; and (i) when the upper plate and the front plate and the rear plate are closed they constitute part of the torso part and one of the head parts is outside the torso part and the other head part is inside the torso part.

As sixth means for achieving the above object and other objects, the invention may also have a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the front plate extends above the projection of the rear plate;

(f) the upper plate is integrally provided with a pinion having the rotational center of the upper plate as its center, and toothless portions are provided on two sides of the pinion;

(g) the rear plate is provided with a side wall, a rack which when the rear plate has opened through a predetermined angle meshes with the pinion of the closed upper plate and rotates the upper plate is provided at the front end of the upper edge of the side wall, an engaging portion which when the rear plate is closed engages with a toothless portion of the pinion of the closed lapper plate and prevents rotation of the upper plate is provided in a substantially central part of the upper edge of the side wall, and a concave portion which does not make contact with the pinion is provided in the upper edge of the side wall between the rack and the engaging portion;

(h) the front plate closes with the upper end of the front plate caused by the first elastic body to abut with the front end of the upper plate closing the upper opening, the rear plate closes with the upper end of the rear plate caused by the second elastic body to abut with the rear end of the upper plate closing the upper opening, and rotation of the upper plate is prevented by the engaging portion provided on the side wall of the rear plate engaging with a toothless portion of the pinion of the upper plate; and (i) when the upper plate and the front plate and the rear plate are closed they constitute part of the torso part and one of the head parts is outside the torso part and the other head part is inside the torso part.

As seventh means consisting of the constitution of the sixth means front-rear reversed, the invention can also have a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the rear plate extends above the projection of the front plate;

(f) the upper plate is integrally provided with a pinion having the rotational center of the upper plate as its center, and toothless portions are provided on two sides of the pinion;

(g) the front plate is provided with a side wall, a rack which when the front plate has opened through a predetermined angle meshes with the pinion of the closed upper plate and rotates the upper plate is provided at the rear end of the upper edge of the side wall, an engaging portion which when the front plate is closed engages with a toothless portion of the pinion of the closed upper plate and prevents rotation of the upper plate is provided in a substantially central part of the upper edge of the side wall, and a concave portion which does not make contact with the pinion is provided in the upper edge of the side wall between-the rack and the engaging portion;

(h) the front plate closes with the upper end of the front plate caused by the first elastic body to abut with the front end of the upper plate closing the upper opening, the rear plate closes with the upper end of the rear plate caused by the second elastic body to abut with the rear end of the upper plate closing the upper opening, and rotation of the upper plate is prevented by the engaging portion provided on the side wall of the front plate engaging with a toothless portion of the pinion of the upper plate; and (i) when the upper plate and the front plate and the rear plate are closed they constitute part of the torso part and one of the head parts is outside the torso part and the other head part is inside the torso part.

As eighth means for achieving the above object and other objects, the invention may also have a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the rear plate is provided with an elastic body for urging the rear plate in the direction in which it closes the rear opening;

(e) an upper/lower pair of projections are provided on the inner side of the front plate and a projection which fits between the pair of projections on the front plate is provided on the inner side of the rear plate, and when the rear plate is closed by the elastic body the projection on the rear plate pushes the lower projection of the front plate and closes the front plate;

(f) the upper plate is integrally provided with a pinion having the rotational center of the upper plate as its center, and toothless portions are provided on two sides of the pinion;

(g) the rear plate is provided with a side wall, a rack which when the rear plate has opened through a predetermined angle meshes with the pinion of the closed upper plate and rotates the upper plate is provided at the front end of the upper edge of the side wall, an engaging portion which when the rear plate is closed engages with a toothless portion of the pinion of the closed upper plate and prevents rotation of the upper plate is provided in a substantially central part of the upper edge of the side wall, and a concave portion which does not make contact with the pinion is provided in the upper edge of the side wall between the rack and the engaging portion;

(h) the rear plate closes with the upper end of the rear plate caused by the elastic body to abut with the rear end of the upper plate closing the upper opening, the front plate closes with the upper end of the front plate caused by the lower projection of the front plate being pushed by the projection of the rear plate to abut with the front end of the upper plate closing the upper opening, and rotation of the upper plate is prevented by the engaging portion provided in the side wall of the rear plate engaging with a toothless portion of the pinion of the upper plate; and (i) when the upper plate and the front plate and the rear plate are closed they constitute part of the torso part and one of the head parts is outside the torso part and the other head part is inside the torso part.

As ninth means consisting of the constitution of the eighth means front-rear reversed, the invention can also have a constitution wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate is provided with an elastic body for urging the front plate in the direction in which it closes the front opening;

(e) an upper/lower pair of projections are provided on the inner side of the rear plate and a projection which fits between the pair of projections on the rear plate is provided on the inner side of the front plate, and when the front plate is closed by the elastic body the projection on the front plate pushes the lower projection of the rear plate and closes the rear plate;

(f) the upper plate is integrally provided with a pinion having the rotational center of the upper plate as its center, and toothless portions are provided on two sides of the pinion;

(g) the front plate is provided with a side wall, a rack which when the front plate has opened through a predetermined angle meshes with the pinion of the closed upper plate and rotates the upper plate is provided at the rear end of the upper edge of the side wall, an engaging portion which when the front plate is closed engages with a toothless portion of the pinion of the closed upper plate and prevents rotation of the upper plate is provided in a substantially central part of the upper edge of the side wall, and a concave portion which does not make contact with the pinion is provided in the upper edge of the side wall between the rack and the engaging portion;

(h) the front plate closes with the upper end of the front plate caused by the elastic body to abut with the front end of the upper plate closing the upper opening, the rear plate closes with the upper end of the rear plate caused by the lower projection of the rear plate being pushed by the projection of the front plate to abut with the rear end of the upper plate closing the upper opening, and rotation of the upper plate is prevented by the engaging portion provided in the side wall of the front plate engaging with a toothless portion of the pinion of the upper plate; and (i) when the upper plate and the front plate and the rear plate are closed they constitute part of the torso part and one of the head parts is outside the torso part and the other head part is inside the torso part.

In a doll toy head rotation device according to the first means, the upper head part is out of the torso part and the lower head part is inside the torso part, the upper opening in the torso part is closed by the upper plate, the front opening in the torso part is closed by the front plate and the rear opening is closed by the rear plate, whereby one external appearance of the torso part is provided.

When the front plate or the rear plate is opened, the other of these two plates also opens substantially simultaneously therewith. When the front plate or the rear plate has opened through a predetermined angle, the pivoting member rotates the rotary body and thereby rotates the upper plate. When the front plate or the rear plate is closed, because the pivoting member does not rotate the rotary body, the upper plate closes the upper opening in an inverted state. When the front plate or the rear plate is closed, the other of these two plates is also closed and another external appearance of the torso part, with the lower head part out and the upper head part inside the torso part, is thereby provided.

A doll toy head rotation device according to the second means can be used in the following way: With the upper head part out and the lower head part inside the torso part, the upper plate closes the upper opening. The front plate closes the front opening under the action of the first elastic body, and the upper end of the front plate abuts with the front end of the upper plate. The inner surface of the front plate can abut with the lower head part and prevent rearward rotation of the upper plate. The rear plate closes the rear opening under the action of the second elastic body, and the upper end of the rear plate abuts with the rear end of the upper plate. The inner surface of the rear plate can abut with the lower head part and prevent forward rotation of the upper plate. In this way, the front plate and the rear plate and the upper plate with the upper head part on the topside thereof when they are closed form a substantially continuous shape and constitute part of the torso part and provide one external appearance of the torso part.

When the rear plate is opened against the elastic force of the second elastic body, the projection provided on the inner side of the rear plate pushes up the projection provided on the inner side of the front plate and the front plate is opened against the elastic force of the first elastic body. In this way the rear plate and the front plate open substantially simultaneously, the upper plate becomes free, and the front and the rear plate do not obstruct rotation of the upper head part and the lower head part.

When the rear plate is Opened the side wall also moves rearward, and when the rear plate has opened through a predetermined angle the rack provided on the side wall meshes with the pinion of the closed upper plate and the upper plate rotates. When the rear plate is released, the rear plate is caused by the elastic force of the second elastic body to close the rear opening, the inner surface of the rear plate abuts with the upper head part and prevents rotation of the upper plate, and the upper end of the rear plate abuts with the front end of the inverted upper plate. Because the projection on the front plate stops being pushed up by the projection on the rear plate, the elastic force of the first elastic body causes the front plate also to close the front opening and the upper end of the front plate abuts with the rear end of the inverted upper plate. In this way, the front plate and the rear plate and the upper plate with the lower head part on the outer side thereof when they are closed form a substantially continuous shape and constitute part of the torso part and provide another external appearance of the torso part.

In a doll toy head rotation device according to the third means, because the side wall is provided on the front plate and the projection of the rear plate extends above the projection on the front plate, the opposite movements to those of a doll toy head rotation device according to the second means can be obtained.

In a doll toy head rotation device according to the fourth means, there is provided an elastic body which urges only the rear plate in the closing direction and a pair of projections are provided on the inner side of the front plate and a projection which fits between the pair of projections on the front plate is provided on the inner side of the rear plate. Because as a result when the rear plate is closed by the elastic body the projection on the rear plate pushes the lower projection on the front plate and closes the front plate, an elastic body for urging the front plate in the closing direction becomes unnecessary, but the same movements as those of a doll toy head rotation device according to the second means can be obtained.

In a doll toy head rotation device according to the fifth means, there is provided an elastic body which urges only the front plate in the closing direction and a pair of projections are provided on the inner side of the rear plate and a projection which fits between the pair of projections on the rear plate is provided on the inner side of the front plate. Because as a result when the front plate is closed by the elastic body the projection on the front plate pushes the lower projection on the rear plate and closes the rear plate, an elastic body for urging the rear plate in the closing direction becomes unnecessary. This movement is the reverse of that of a doll toy head rotation device according to the fourth means.

A doll toy head rotation device according to the sixth means can be used in the following way: With the upper head part out and the lower head part inside the torso part, when the front plate closes the front opening under the action of the first elastic body and the rear plate closes the rear opening under the action of the second elastic body, the upper plate closes the upper opening with rotation of the upper plate being prevented by the engaging portion provided in the side wall of the rear plate engaging with a toothless portion of the pinion of the upper plate. In this way, the front plate and the rear plate and the upper plate with the upper head part on the outer side thereof when they are closed form a substantially continuous shape and constitute part of the torso part and provide one external appearance of the torso part.

When the rear plate is opened against the elastic force of the second elastic body, the projection provided on the inner side of the rear plate pushes up the projection provided on the inner side of the front plate and the front plate is opened against the elastic force of the first elastic body. In this way, the rear plate and the front plate open substantially simultaneously and do not obstruct the upper head part and the lower head part.

When the rear plate opens the side wall also moves rearward, the engaging portion of the side wall disengages from the toothless portion of the pinion and the upper plate becomes free. When the rear plate has opened through a predetermined angle, the rack provided on the side wall meshes with the pinion of the closed upper plate and the upper plate rotates. When the rear plate is released, the rear plate is caused by the elastic force of the second elastic body to close the rear opening. Because the engaging portion provided on the side wall of the rear plate engages with the toothless portion of the pinion of the upper plate, the upper plate closes the upper opening with its rotation thereby prevented. Because the projection of the front plate stops being pushed up by the projection on the rear plate, the front plate closes the front opening under the action of the elastic force of the second elastic body. In this way, the front plate and the rear plate and the upper plate with the lower head part on the outer side thereof when they are closed form a substantially continuous shape and constitute part of the torso part and provide another external appearance of the torso part.

In a doll toy head rotation device according to the seventh means, because the side wall is provided on the front plate and the projection on the rear plate extends above the projection on the front plate, movements opposite to those of a doll toy head rotation device according to the sixth means can be obtained.

In a doll toy head rotation device according to the eighth means, there is provided an elastic body urging only the rear plate in the closing direction, a pair of projections are provided on the inner side of the front plate and a projection which fits between the pair of projections on the front plate is provided on the inner side of the rear plate. Because as a result when the rear plate is closed by the elastic body the projection on the rear plate pushes the lower of the two projections on the front plate and closes the front plate, an elastic body for urging the front plate in the closing direction becomes unnecessary, but the same movements as those of a doll toy head rotation device according to the sixth means can be obtained.

In a doll toy head rotation device according to the ninth means, there is provided an elastic body which urges only the front plate in the closing direction and a pair of projections are provided on the inner side of the rear plate and a projection which fits between the pair of projections on the rear plate is provided on the inner surface of the front plate. Because as a result when the front plate is closed by the elastic body the projection on the front plate pushes the lower of the two projections on the rear plate and closes the rear plate, an elastic body for urging the rear plate in the closing direction becomes unnecessary. These movements are the reverse of those of a doll toy head rotation device according to the eighth means.

DETAILED DESCRIPTION OF THE PREFERRED EMBODIMENTS

Figure 1:
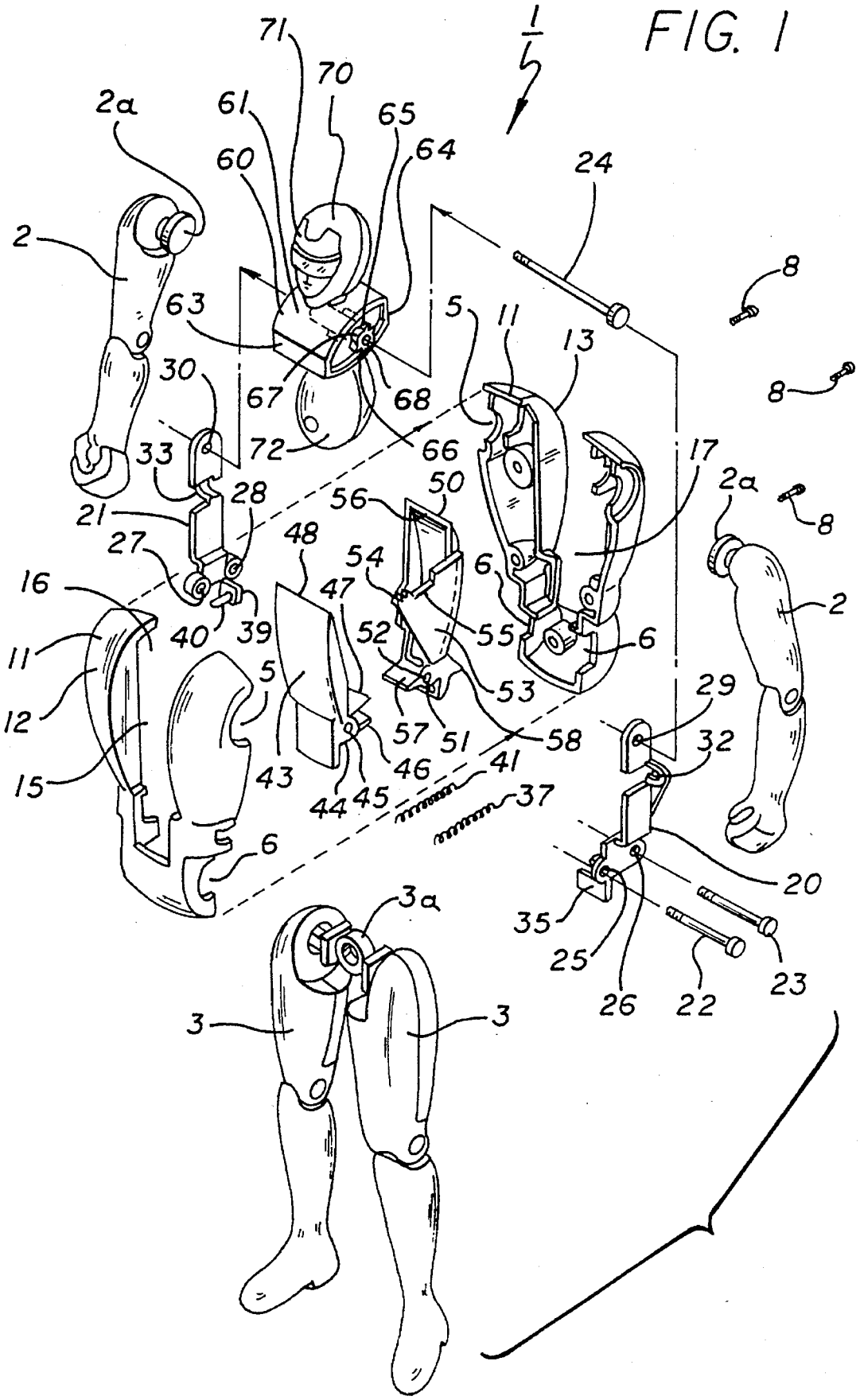
FIG. 1 is an exploded perspective view of a preferred embodiment of a doll toy head rotation device according to the invention.
Figure 2:
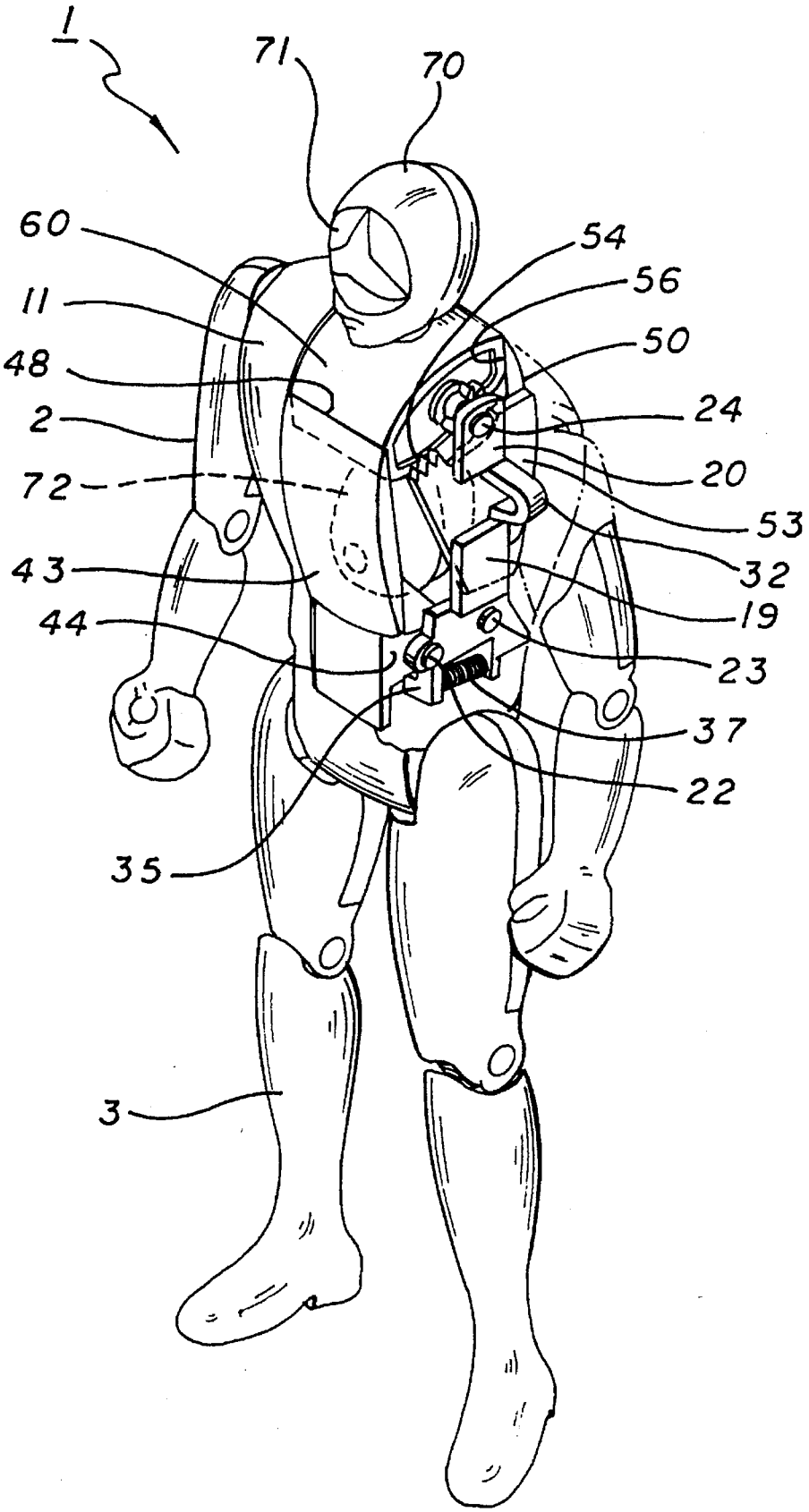
FIG. 2 is a partially cutaway assembly perspective view of the preferred embodiment.
Figure 3:
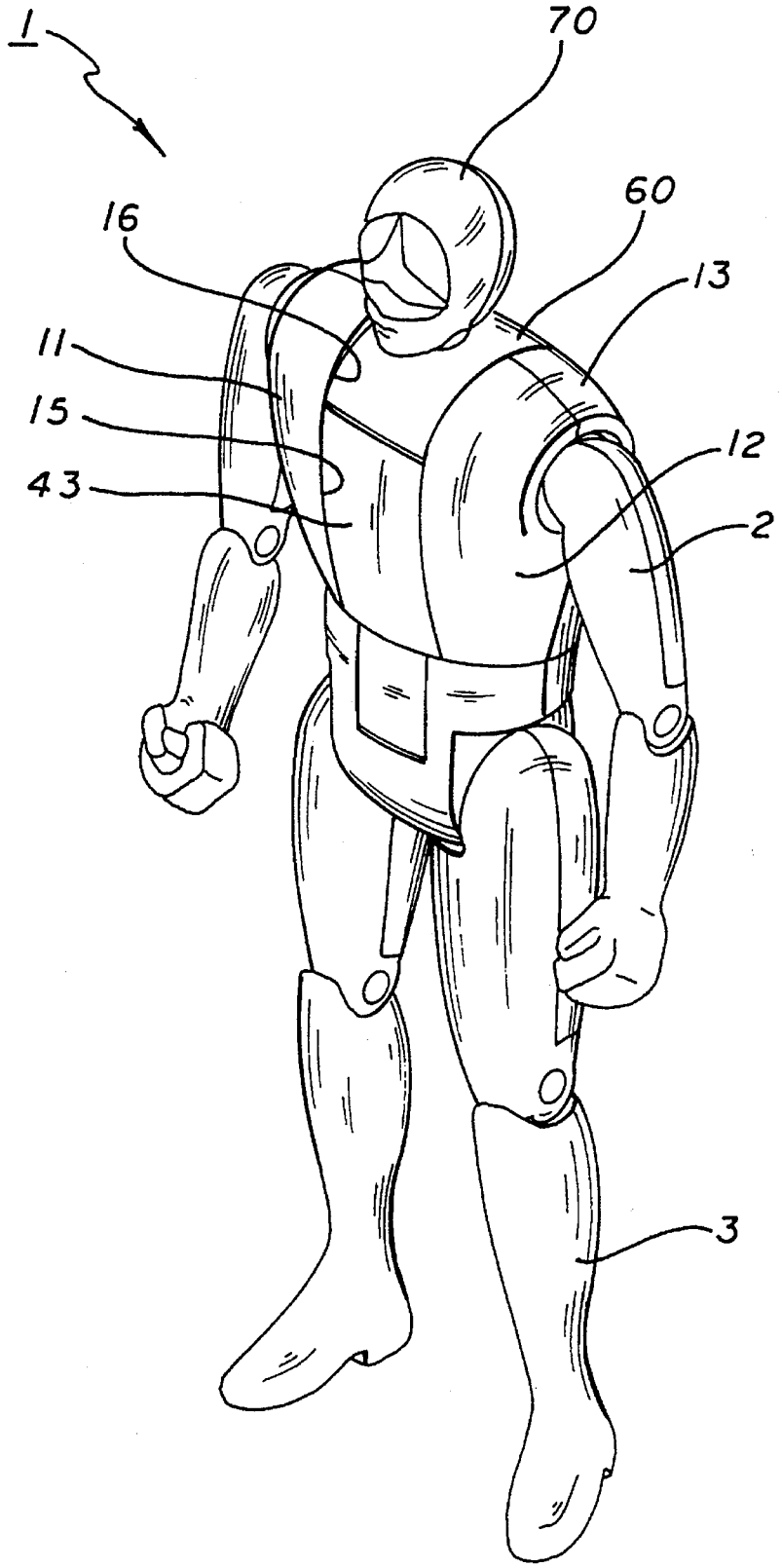
FIG. 3 is an assembly perspective view of the preferred embodiment.
Figure 4B:
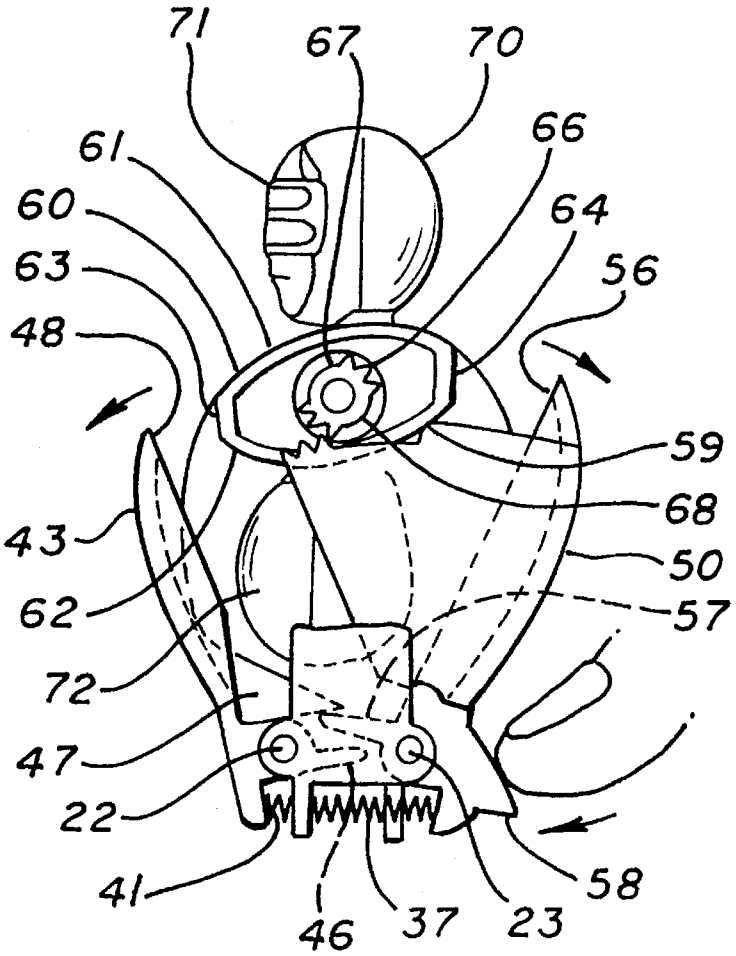
FIG. 4(*a*) through FIG. 4(*e*) are side views illustrating the operation of the preferred embodiment.
Figure 4A:
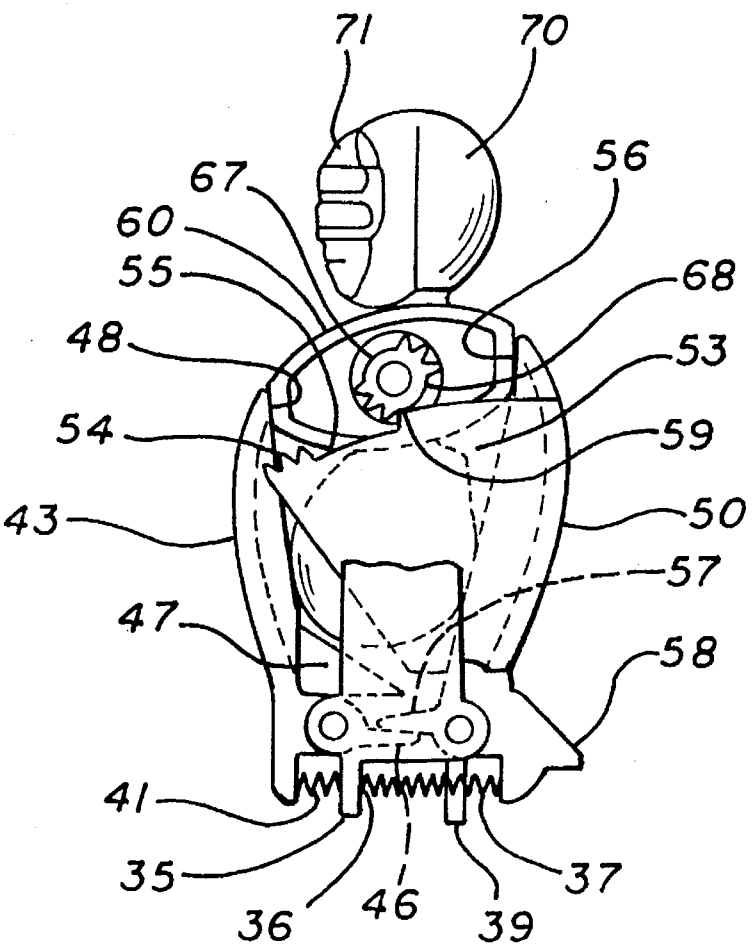
Figure 4D:
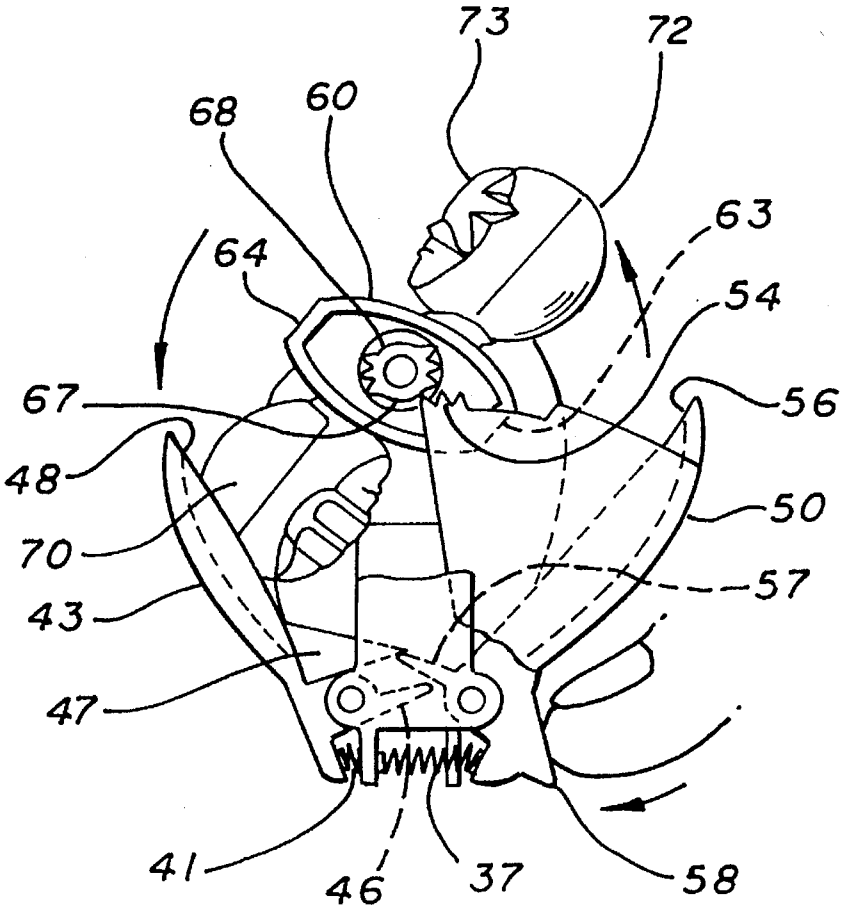
Figure 4C:
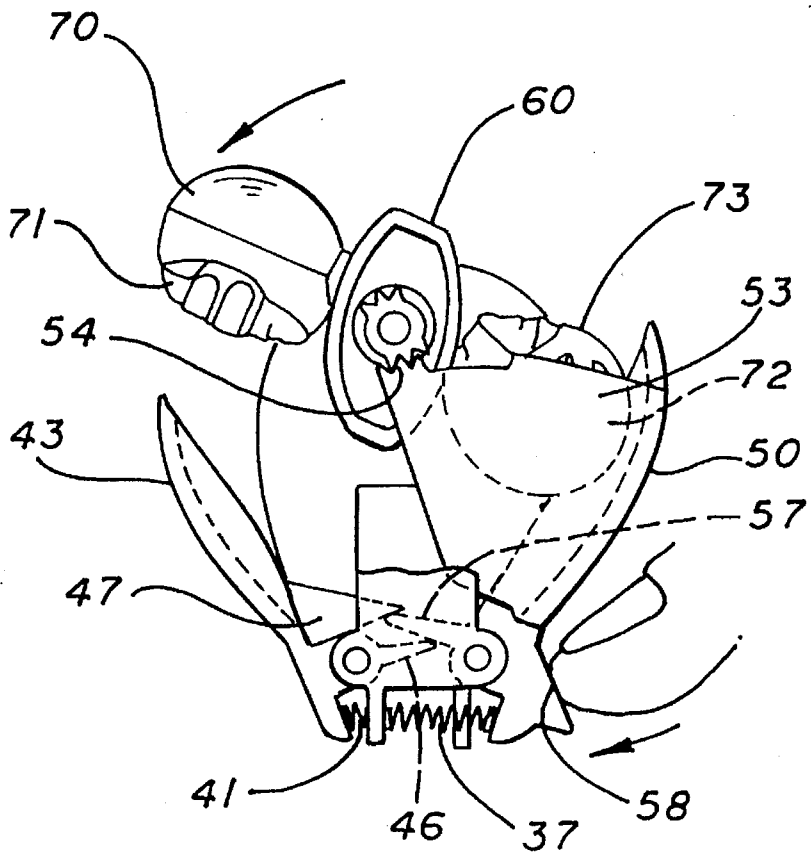
Figure 4E:
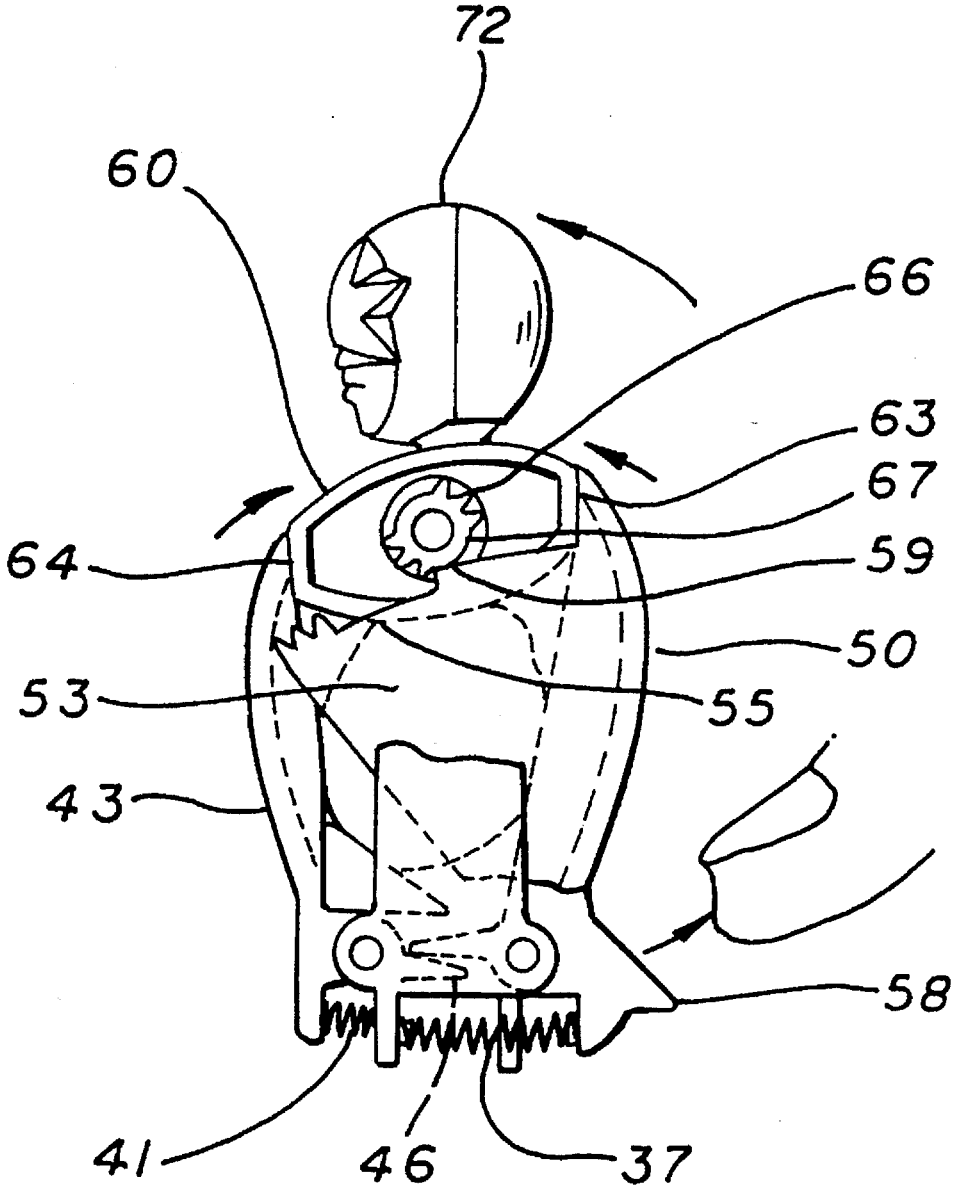

A preferred embodiment of the invention will now be described with reference to the accompanying drawings. FIG. 1 is an exploded perspective view of the preferred embodiment, FIG. 2 is a partially cutaway assembly perspective view, FIG. 3 is an assembly perspective view and FIGS. 4(*a*) to 4(*e*) are side views illustrating the operation of the preferred embodiment. Referring to FIG. 3, a doll toy 1 is made up of a torso part 11, arm parts 2 and leg parts 3. The torso part 11 comprises a front member 12 constituting a chest side and a rear member 13 constituting a back side fixed together by screws 8 or adhesive or the like (see FIG. 1).

As shown in FIG. 1, shaft receiving holes 5 and 6 are provided in shoulder and waist portions of the torso part 11. A joint shaft 2*a* is rotatably fitted in each shaft receiving hole 5. A joint shaft 3*a* is disposed in the shaft receiving holes 6, and the leg parts 3 are attached to the ends of this joint shaft 3*a*.

A front opening 15 is provided in the front of the torso part 11, an upper opening 16 is provided in the top of the torso part 11, and a rear opening 17 is provided in the rear of the torso part 11. The front opening 15 and the upper opening 16 are continuous with each other and the upper opening 16 and the rear opening 17 are continuous with each other.

A frame member 19 is mounted inside the torso part 11. This frame mender 19 consists of a left shaft receiving plate 20 and a right shaft receiving plate 21 fixed together integrally. A front shaft receiving hole 25 and a rear shaft receiving hole 26 are provided in the front and rear of the lower part of the left shaft receiving plate 20. Also, a front shaft receiving hole 27 and a rear shaft receiving hole 28 are provided in the front and rear of the lower part of the right shaft receiving plate 21. A front pin 22 is fixed in the front shaft receiving hole 25 in the left shaft receiving plate 20 and the front shaft receiving hole 27 in the right shaft receiving plate 21, and a rear pin 23 is fixed in the rear shaft receiving hole 26 in the left shaft receiving plate 20 and the rear shaft receiving hole 28 in the right shaft receiving plate 21. An upper shaft receiving hole 29 is provided in the upper part of the left shaft receiving plate 20, and also an upper shaft receiving hole 30 is provided in the upper part of the right shaft receiving plate 21. An upper pin 24 is fixed in the upper shaft receiving hole 29 and the upper shaft receiving hole 30.

A substantially U-shaped shaft-avoiding part 32 is provided in the left side of the left shaft receiving plate 20, and a substantially U-shaped shaft-avoiding part 33 is also provided in the right side of the right shaft receiving plate 21. Screws 8, 8 fixing together the front member 12 and the rear member 13 of the torso part 11 pass through these shaft-avoiding parts 32 and 33, and the frame member 19 is thereby fixed in the torso part 11. The frame member 19 can be fixed by a fixing method other than this, and for example can be fixed by adhesion with an adhesive.

A spring receiving plate 35 is provided at the bottom of the left shaft receiving plate 20, and as shown in FIG. 4(*a*) a small projection 36 on which is fitted a compression spring 37 (second elastic body) is provided projecting from this spring receiving plate 35. Similarly, a spring receiving plate 39 is provided at the bottom of the right shaft receiving plate 21, and a small projection 40 on which is fitted a compression spring 41 (first elastic body) is provided projecting from this spring receiving plate 39.

A front plate 43 constituting part of the front member 12 is so mounted in the front opening 15 that it opens and closes the front opening 15. A horizontal boss 44 is provided on the inner side of the lower part of this front plate 43, and a shaft receiving hole 45 is provided in this boss 44. The front pin 22 passes through this shaft receiving hole 45, and the front plate 43 is thereby mounted pivotally back and forth about this front pin 22 and opens and closes the front opening 15.

An engaging projection 46 (projection) substantially perpendicular to the front plate 43 is provided on the boss 44 of the front plate 43. Also, a triangular engaging piece 47 (projection) is provided on the front plate 43 above the engaging projection 46. The inner side of the front plate 43 below the boss 44 is pressed upon by the compression spring 41 mounted on the spring receiving plate 39 of the right shaft receiving plate 21, and the front plate 43 is urged in the closing direction by this compression spring 41.

A rear plate 50 constituting part of the rear member 13 is so mounted in the rear opening 17 that it opens and closes the rear opening 17. A horizontal boss 51 is provided on the inner side of the lower part of the rear plate 50, and a shaft receiving hole 52 is provided in this boss 51. The rear pin 23 passes through this shaft receiving hole 52, and the rear plate 50 is thereby mounted rotatably back and forth about this front pin 23 and opens and closes the rear opening 17.

An engaging projection 57 (projection) which is substantially perpendicular to the rear plate 50 and fits between the engaging piece 47 and the engaging projection 46 is provided on the boss 51 of the rear plate 50. The inner side of the rear plate 50 below the boss 51 is pressed upon by the compression spring 37 mounted on the spring receiving plate 35 of the left shaft receiving plate 20, and the rear plate 50 is urged in the closing direction by this compression spring 37. A pushing projection 58 for being pushed by hand against the resistance of the compression spring 37 is provided on the outer side of the rear plate 50 below the boss 51.

A side wall 53 is provided on the left side of the rear plate 50. A rack 54 which pivots about the rear pin 23 is formed at the front end of the upper edge of this side wall 53. Also, an engaging step 59 (engaging portion) is formed in a substantially central part of the upper edge of the side wall 53, and a concave portion 55 which does not make contact with a pinion 66 which will be further discussed later is formed in the upper edge of the side wall 53 between the engaging step 59 and the rack 54.

An upper plate 60 constituting part of the front member 12 and the rear member 13 is so mounted in the upper opening 16 that it opens and closes the upper opening 16. This upper plate 60 has gently curving upper and lower surfaces 61 and 62, and the upper surface 61 and the lower surface 62 are so shaped that they can constitute part of the shoulder portion of the doll toy 1. Front and rear engaging ends 63 and 64 which engage with the upper end 48 of the front plate 43 and the upper end 56 of the rear plate 50 are provided at the front and rear ends of the upper plate 60.

A horizontal shaft receiving hole 65 is provided in a substantially central portion of the upper plate 60. The upper pin 24 passes through this shaft receiving hole 65, and the upper plate 60 is thereby mounted rotatably back and forth about the upper pin 24 and can open and close the upper opening 16. A pinion 66 concentric with the shaft receiving hole 65 is provided on the left side surface of the upper plate 60. This pinion 66 has toothless portions 67 and 68 on two sides and can mesh with the rack 54 formed on the side wall 53 of the rear plate 50. An upper head part 70 is provided on the upper surface 61 of the upper plate 60 with its face 71 facing forward. A lower head part 72 is provided on the lower surface 62 of the upper plate 60 with its face 73 facing rearward.

The front plate 43 and the upper plate 60 with its upper surface 61 facing outward and the rear plate 50 when they are closed form a substantially continuous shape and constitute part of the torso part 11 and provide one external appearance of the torso part 11. When the upper head part 70 is out of the torso part 11, the upper end 48 of the front plate 43 is caused by the compression spring 41 to be in abutment with the front engaging end 63 of the upper plate 60, and the upper end 56 of the rear plate 50 is caused by the compression spring 37 to be in abutment with the rear engaging end 64 of the upper plate 60.

Next, based on the constitution described above, the operation of the preferred embodiment will be explained. When the upper head part 70 is out, as shown in FIG. 4(*a*), the rear plate 50 is urged by the compression spring 37 in the direction in which it closes the rear opening 17, and the rear plate 50 closes the rear opening 17 with the upper end 56 of the rear plate 50 in engagement with the rear engaging end 64 of the upper plate 60. The front plate 43 is urged by the compression spring 41 in the direction in which it closes the front opening 15, and the front plate 43 closes the front opening 15 with the upper end 48 of the front plate 43 in engagement with the front engaging end 63 of the upper plate 60. Because the engaging projection 46 of the front plate 43 is underneath the engaging projection 57 of the rear plate 50, even if an attempt is made to pivot the front plate 43 in its opening direction the engaging projection 46 engages with the engaging projection 57 and the front plate 43 cannot open.

The upper plate 60 is prevented from rotating forward (in the direction in which the face 71 of the upper head part 70 is facing) by the engaging step 59 formed in the substantially central part of the upper edge of the side wall 53 of the rear plate 50 engaging with a toothless portion 68 of the pinion 66. The upper plate 60 is also prevented from rotating rearward (in the direction in which the back of the upper head part 70 is facing) by the back of the lower head part 72 abutting with the inner surface of the front plate 43.

From the state described above, when as shown in FIG. 4(*b*) the pushing projection 58 is pushed against the resistance of the compression spring 37, the rear plate 50 pivots about the rear pin 23 in the direction in which it opens the rear opening 17. The engaging projection 57 of the rear plate 50 engages with and pushes up the engaging piece 47 of the front plate 43, and the front plate 43 pivots about the front pin 22 in the direction in which it opens the front opening 15. Because as shown in FIG. 4(*c*) the pivoting of the rear plate 50 causes the engaging step 59 of the side wall 53 to move rearward, the upper plate 60 becomes free; subsequently, when the rear plate 50 opens through a predetermined angle, the rack 54 meshes with the pinion 66 and rotates the upper plate 60 forward.

When the front plate 43 and the rear plate 50 open further, as shown in FIG. 4(*d*), because of the toothless portion 67 the meshing of the pinion 66 and the rack 54 is disengaged and the upper plate 60 is rotated forward by inertia. Because the front plate 43 and the rear plate 50 are fully open, the upper head part 70 and the lower head part 72 rotate without making contact with the front plate 43 or the rear plate 50. The pushing of the pushing projection 58 is carried out momentarily, and when the pushing is released the restoring force of the compression spring 37 causes the rear plate 50 to pivot in the closing direction. Because the engaging projection 57 of the rear plate 50 then ceases to push up the engaging piece 47 of the front plate 43, under the restoring force of the compression spring 41 the front plate 43 also pivots in the closing direction.

When the rear plate 50 pivots in the closing direction, because as shown in FIG. 4(*d*) the rack 54 escapes in the toothless portion 67 of the pinion 66, the rear plate 50 can close the rear opening 17 smoothly. Sometimes the rotation of the upper plate 60 is rapid and the pinion 66 rotates and the front end of the rack 54 engages with the teeth of the pinion 66 before the rear plate 50 closes. In this case, the upper plate 60 rotates slightly rearward and the upper head part 70 projects forward, but because the front plate 43 is not completely closed, the upper head part 70 does not abut with-the front plate 43. Furthermore, because the pinion 66 soon moves into the concave portion 55 in the side wall 53 and the upper plate 60 becomes free, the inner surface of the front plate 43 pushes the inverted upper head part 70 into the torso part 11.

Because the toothless portion 67 of the pinion 66 of the upper plate 60 engages with the engaging step 59 of the side wall 53, as shown in FIG. 4(*e*), the upper plate 60 comes to a standstill after rotating through approximately 180°. As a result, the lower head part 72 is out and the upper end 56 of the rear plate 50 is caused by the compression spring 37 to engage with the front engaging end 63 of the upper plate 60. Also, the upper end 48 of the front plate 43 is caused by the compression spring 41 to engage with the rear engaging end 64 of the upper plate 60. In this way, when the pushing projection 58 is pushed, the head parts instantaneously switch.

When the lower head part 72 has emerged from the torso part 11, the rear plate 50 is caused by the compression spring 37 to close the rear opening 17, the front plate 43 is caused by the compression spring 41 to close the front opening 15 and the upper plate 60 closes the upper opening 16. The front plate 43 and the upper plate 60 with its lower surface 62 facing outward and the rear plate 50 form a substantially continuous shape and constitute a part of the torso part 11 and provide another external appearance of the torso part 11.

In the preferred embodiment described above, in order to keep the position in which the upper plate 60 is held stationary fixed at all times, the engaging step 59 for engaging with the toothless portions 67 and 68 is provided in the side wall 53. However, because the lower head part 72 or the upper head part 70 inside the torso part 11 is held between and forcibly held stationary by the front plate 43 and the rear plate 50 which are urged closed by compression springs, switching of the head parts can be carried out even if there is no engaging step 59.

In the above preferred embodiment, even if the compression spring 41 is removed, because when the rear plate 50 is closed by the compression spring 37 the engaging projection 57 of the rear plate 50 pushes down the engaging projection 46 of the front plate 43, the front plate 43 also closes at the same time. Therefore, although the compression spring 41 is used to supplement the downward pushing force of the engaging projection 57, the compression spring 41 may be dispensed with without this causing any functional hindrance.

Nor is any functional hindrance caused if, reversely, the engaging projection 46 of the front plate 43 is removed, because the front plate 43 is urged in the closing direction by the compression spring 41 at all times. However, because when the front plate 43 is closed the engaging projection 46 of the front plate 43 is pushed down upon by the engaging projection 57 of the rear plate 50 as described above, the front plate 43 cannot open until the rear plate 50 opens. In this sense, the engaging projection 46 is also a locking member.

As means for linking the front plate 43 and the rear plate 50, the engaging piece 47 and the engaging projection 57 were used; however, these two plates can alternatively be linked by a sector-shaped gear being provided on the boss 44 and a sector-shaped gear meshing with the sector-shaped gear of the boss 44 being provided on the other boss 51.

In the preferred embodiment described above, in order to make the rotation of the upper plate 60 certain, the pinion 66 and the rack 54 were used; however, alternatively, it is possible to provide a rotary body having high frictional resistance instead of the pinion 66 and use a pivoting member having a high frictional resistance for abutting with and rotating this rotary body instead of the rack 54.

In the preferred embodiment described above, the side wall 53 is provided on the rear plate 50, the pair of projections 46 and 47 are provided on the front plate 43 and the projection 57 fitting between the pair of projections 46 and 47 is provided on the rear plate 50; however, if in the reverse of this a side wall is provided on the front plate 43 and a pair of projections are provided on the rear plate 50 and a projection fitting between the pair of projections on the rear plate 50 is provided on the front plate 43, the opposite movements to those described above can be obtained.

In the above preferred embodiment, the front plate 43, the upper plate 60 and the rear plate 50 are mounted on the frame member 19, but they may alternatively be mounted on the torso part 11.

In a doll toy head part rotation device according to this invention, because the front plate and the rear plate open from their closed states substantially simultaneously and open fully before the head parts switch, there is the merit that the head parts can be switched smoothly without them hitting the front plate or the rear plate. Also, there is the merit that when the front plate or the rear plate opens through a predetermined angle the pivoting member mounted thereon rotates the rotary body mounted on the upper plate and the head parts mounted on the upper and lower surfaces of the upper plate can be switched instantaneously. When the rotary body is made a pinion and the pivoting member is made a rack, there is the merit that the rotation of the upper plate is still more certain. Furthermore, because the openings in the torso part are closed by the front plate, the upper plate and the rear plate, the external appearance of the torso part is not impaired and the interior of the torso part cannot be seen from the outside, and as a result there is the merit that when switching of the head parts is carried out instantaneously it is possible to surprise someone watching.

Thus, it is seen that a doll toy head rotation device is provided. One skilled in the art will appreciate that the present invention can be practiced by other than the preferred embodiments which are presented for purposes of illustration and not of limitation, and the present invention is limited only by the claims which follow.

What is claimed is:

1. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are so linked to each other that they open substantially simultaneously; and (e) the upper plate is provided with a rotary body having the rotational center of the upper plate as its center; and (f) the front plate or the rear plate is provided with a pivoting member which after that plate opens through a predetermined angle rotates the rotary body and does not rotate the rotary body when the plate closes.

2. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the front plate extends above the projection of the rear plate;

(f) the upper plate is integrally provided with a pinion having the rotational center of the upper plate as its center, and toothless portions are provided on two sides of the pinion;

(g) the rear plate is provided with a side wall, and a rack which when the rear plate has opened through a predetermined angle meshes with the pinion of the closed upper plate and rotates the upper plate is provided at the front end of the upper edge of the side wall;

(h) the upper end of the front plate when it is closing the front opening under the action of the first elastic body abuts with the front end of the upper plate and the upper end of the rear plate when it is closing the rear opening under the action of the second elastic body abuts with the rear end of the upper plate; and (i) when the upper plate and the front plate and the rear plate are closed they constitute part of the torso part and one of the head parts is outside the torso part and the other head part is inside the torso part.

3. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the rear plate extends above the projection of the front plate;

(f) the upper plate is integrally provided with a pinion having the rotational center of the upper plate as its center, and toothless portions are provided on two sides of the pinion;

(g) the front plate is provided with a side wall, and a rack which when the front plate has opened through a predetermined angle meshes with the pinion of the closed upper plate and rotates the upper plate is provided at the rear end of the upper edge of the side wall;

(h) the upper end of the front plate when it is closing the front opening under the action of the first elastic body abuts with the front end of the upper plate and the upper end of the rear plate when it is closing the rear opening under the action of the second elastic body abuts with the rear end of the upper plate; and (i) when the upper plate and the front plate and the rear plate are closed they constitute part of the torso part and one of the head parts is outside the torso part and the other head part is inside the torso part.

4. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the rear plate is provided with an elastic body for urging the rear plate in the direction in which it closes the rear opening;

(e) an upper/lower pair of projections are provided on the inner side of the front plate and a projection which fits between the pair of projections on the front plate is provided on the inner side of the rear plate, and when the rear plate is closed by the elastic body the projection on the rear plate pushes the lower projection of the front plate and closes the front plate;

(f) the upper plate is integrally provided with a pinion having the rotational center of the upper plate as its center, and toothless portions are provided on two sides of the pinion;

(g) the rear plate is provided with a side wall, and a rack which when the rear plate has opened through a predetermined angle meshes with the pinion of the closed upper plate and rotates the upper plate is provided at the front end of the upper edge of the side wall;

(h) the upper end of the rear plate when it is closing the rear opening under the action of the elastic body abuts with the rear end of the upper plate and the upper end of the front plate when it is closing the front opening under the action of the projection of the rear plate pushing the lower projection of the front plate abuts with the front end of the upper plate; and (i) when the upper plate and the front plate and the rear plate are closed they constitute part of the torso part and one of the head parts is outside the torso part and the other head part is inside the torso part.

5. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate is provided with an elastic body for urging the rear plate in the direction in which it closes the front opening;

(e) an upper/lower pair of projections are provided on the inner side of the rear plate and a projection which fits between the pair of projections on the rear plate is provided on the inner side of the front plate, and when the front plate is closed by the elastic body the projection on the front plate pushes the lower projection of the rear plate and closes the rear plate;

(f) the upper plate is integrally provided with a pinion having the rotational center of the upper plate as its center, and toothless portions are provided on two sides of the pinion;

(g) the front plate is provided with a side wall, and a rack which when the front plate has opened through a predetermined angle meshes with the pinion of the closed upper plate and rotates the upper plate is provided at the rear end of the upper edge of the side wall;

(h) the upper end of the front plate when it is closing the front opening under the action of the elastic body abuts with the front end of the upper plate and the upper end of the rear plate when it is closing the rear opening under the action of the projection of the front plate pushing the lower projection of the rear plate abuts with the rear end of the upper plate; and (i) when the upper plate and the front plate and the rear plate are closed they constitute part of the torso part and one of the head parts is outside the torso part and the other head part is inside the torso part.

6. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the front plate extends above the projection of the rear plate;

(f) the upper plate is integrally provided with a pinion having the rotational center of the upper plate as its center, and toothless portions are provided on two sides of the pinion;

(g) the rear plate is provided with a side wall, a rack which when the rear plate has opened through a predetermined angle meshes with the pinion of the closed upper plate and rotates the upper plate is provided at the front end of the upper edge of the side wall, an engaging portion which when the rear plate is closed engages with a toothless portion of the pinion of the closed upper plate and prevents rotation of the upper plate is provided in a substantially central part of the upper edge of the side wall, and a concave portion which does not make contact with the pinion is provided in the upper edge of the side wall between the rack and the engaging portion;

(h) the front plate closes with the upper end of the front plate caused by the first elastic body to abut with the front end of the upper plate closing the upper opening, the rear plate closes with the upper end of the rear plate caused by the second elastic body to abut with the rear end of the upper plate closing the upper opening, and rotation of the upper plate is prevented by the engaging portion provided on the side wall of the rear plate engaging with a toothless portion of the pinion of the upper plate; and (i) when the upper plate and the front plate and the rear plate are closed they constitute part of the torso part and one of the head parts is outside the torso part and the other head part is inside the torso part.

7. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate and the rear plate are provided with first and second elastic bodies respectively which urge them in the directions in which they close the front opening and the rear opening;

(e) the front plate and the rear plate are each provided with a projection which projects inward and when the front plate and the rear plate are closed the projection of the rear plate extends above the projection of the front plate;

(f) the upper plate is integrally provided with a pinion having the rotational center of the upper plate as its center, and toothless portions are provided on two sides of the pinion;

(g) the front plate is provided with a side wall, a rack which when the front plate has opened through a predetermined angle meshes with the pinion of the closed upper plate and rotates the upper plate is provided at the rear end of the upper edge of the side wall, an engaging portion which when the front plate is closed engages with a toothless portion of the pinion of the closed upper plate and prevents rotation of the upper plate is provided in a substantially central part of the upper edge of the side wall, and a concave portion which does not make contact with the pinion is provided in the upper edge of the side wall between the rack and the engaging portion;

(h) the front plate closes with the upper end of the front plate caused by the first elastic body to abut with the front end of the upper plate closing the upper opening, the rear plate closes with the upper end of the rear plate caused by the second elastic body to abut with the rear end of the upper plate closing the upper opening, and rotation of the upper plate is prevented by the engaging portion provided on the side wall of the front plate engaging with a toothless portion of the pinion of the upper plate; and (i) when the upper plate and the front plate and the rear plate are closed they constitute part of the torso part and one of the head parts is outside the torso part and the other head part is inside the torso part.

8. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the rear plate is provided with an elastic body for urging the rear plate in the direction in which it closes the rear opening;

(e) an upper/lower pair of projections are provided on the inner side of the front plate and a projection which fits between the pair of projections on the front plate is provided on the inner side of the rear plate, and when the rear plate is closed by the elastic body the projection on the rear plate pushes the lower projection of the front plate and closes the front plate;

(f) the upper plate is integrally provided with a pinion having the rotational center of the upper plate as its center, and toothless portions are provided on two sides of the pinion;

(g) the rear plate is provided with a side wall, a rack which when the rear plate has opened through a predetermined angle meshes with the pinion of the closed upper plate and rotates the upper plate is provided at the front end of the upper edge of the side wall, an engaging portion which when the rear plate is closed engages with a toothless portion of the pinion of the closed upper plate and prevents rotation of the upper plate is provided in a substantially central part of the upper edge of the side wall, and a concave portion which does not make contact with the pinion is provided in the upper edge of the side wall between the rack and the engaging portion;

(h) the rear plate closes with the upper end of the rear plate caused by the elastic body to abut with the rear end of the upper plate closing the upper opening, the front plate closes with the upper end of the front plate caused by the lower projection of the front plate being pushed by the projection of the rear plate to abut with the front end of the upper plate closing the upper opening, and rotation of the upper plate is prevented by the engaging portion provided in the side wall of the rear plate engaging with a toothless portion of the pinion of the upper plate; and (i) when the upper plate and the front plate and the rear plate are closed they constitute part of the torso part and one of the head parts is outside the torso part and the other head part is inside the torso part.

9. A doll toy head rotation device wherein:

(a) there is provided a hollow torso part and a front opening is provided in the front of the torso part, an upper opening is provided in the top of the torso part and a rear opening is provided in the rear of the torso part, the front opening being continuous with the upper opening and the upper opening being continuous with the rear opening;

(b) a front plate which opens and closes the front opening is mounted in the front opening open/closably about its lower portion, a rear plate which opens and closes the rear opening is mounted in the rear opening open/closably about its lower portion, and an upper plate which opens and closes the upper opening is mounted in the upper opening rotatably about its substantially central portion;

(c) the upper plate has an upper head part mounted on its upper surface and a lower head part mounted on its lower surface;

(d) the front plate is provided with an elastic body for urging the front plate in the direction in which it closes the front opening;

(e) an upper/lower pair of projections are provided on the inner side of the rear plate and a projection which fits between the pair of projections on the rear plate is provided on the inner side of the front plate, and when the front plate is closed by the elastic body the projection on the front plate pushes the lower projection of the rear plate and closes the rear plate;

(f) the upper plate is integrally provided with a pinion having the rotational center of the upper plate as its center, and toothless portions are provided on two sides of the pinion;

(g) the front plate is provided with a side wall, a rack which when the front plate has opened through a predetermined angle meshes with the pinion of the closed upper plate and rotates the upper plate is provided at the rear end of the upper edge of the side wall, an engaging portion which when the front plate is closed engages with a toothless portion of the pinion of the closed upper plate and prevents rotation of the upper plate is provided in a substantially central part of the upper edge of the side wall, and a concave portion which does not make contact with the pinion is provided in the upper edge of the side wall between the rack and the engaging portion;

(h) the front plate closes with the upper end of the front plate caused by the elastic body to abut with the front end of the upper plate closing the upper opening, the rear plate closes with the upper end of the rear plate caused by the lower projection of the rear plate being pushed by the projection of the front plate to abut with the rear end of the upper plate closing the upper opening, and rotation of the upper plate is prevented by the engaging portion provided in the side wall of the front plate engaging with a toothless portion of the pinion of the upper plate; and (i) when the upper plate and the front plate and the rear plate are closed they constitute part of the torso part and one of the head parts is outside the torso part and the other head part is inside the torso part.

* * * * *

UNITED STATES PATENT AND TRADEMARK OFFICE

CERTIFICATE OF CORRECTION

PATENT NO. : 5,588,898

DATED : December 31, 1996

INVENTOR(S) : Hideki Ooba

It is certified that error appears in the above-indentified patent and that said Letters Patent is hereby corrected as shown below:

On the title page item [73],

The following assignee is added to the Assignment field appearing on the first page of the patent:

--Kabushiki Kaisha Bandai, Japan--.

Signed and Sealed this

Twenty-second Day of July, 1997

Bruce Lehman

*Attest:*

BRUCE LEHMAN

*Attesting Officer*

*Commissioner of Patents and Trademarks*